US010170831B2

(12) United States Patent
Bowers et al.

(10) Patent No.: US 10,170,831 B2
(45) Date of Patent: Jan. 1, 2019

(54) SYSTEMS, METHODS AND DEVICES FOR MECHANICALLY PRODUCING PATTERNS OF ELECTROMAGNETIC ENERGY

(71) Applicant: Elwha LLC, Bellevue, WA (US)

(72) Inventors: Jeffrey A. Bowers, Bellevue, WA (US); Tom Driscoll, San Diego, CA (US); Roderick A. Hyde, Redmond, WA (US); Jordin T. Kare, San Jose, CA (US); David R. Smith, Durham, NC (US); Clarence T. Tegreene, Mercer Island, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 479 days.

(21) Appl. No.: 14/835,547

(22) Filed: Aug. 25, 2015

(65) Prior Publication Data

US 2017/0062923 A1 Mar. 2, 2017

(51) Int. Cl.

| | |
|---|---|
| ***H01Q 3/20*** | (2006.01) |
| ***H01Q 25/00*** | (2006.01) |
| ***H01Q 21/29*** | (2006.01) |
| ***H01Q 3/18*** | (2006.01) |
| ***H01Q 15/00*** | (2006.01) |
| *H01Q 3/00* | (2006.01) |

(52) U.S. Cl.

CPC ..... *H01Q 3/20* (2013.01); *H01Q 3/18* (2013.01); *H01Q 15/0086* (2013.01); *H01Q 21/29* (2013.01); *H01Q 25/00* (2013.01)

(58) Field of Classification Search

CPC ..... H01Q 3/20; H01Q 25/00; H01Q 21/29; H01Q 3/18; H01Q 15/0086; H01P 1/16; H01P 1/207; H01P 1/184

USPC ..... 333/197, 256, 259, 222–233

See application file for complete search history.

(56) References Cited

U.S. PATENT DOCUMENTS

| | | | | |
|---|---|---|---|---|
| 4,229,745 | A * | 10/1980 | Kruger | H01Q 25/00 |
| 4,633,258 | A * | 12/1986 | Mok et al. | H01P 1/207 |
| 5,917,455 | A * | 6/1999 | Huynh et al. | H01P 1/184 |
| 8,040,586 | B2 | 10/2011 | Smith et al. | |
| 2002/0021197 | A1 * | 2/2002 | Elco | H01P 1/16 |
| 2010/0156573 | A1 | 6/2010 | Smith et al. | |

(Continued)

OTHER PUBLICATIONS

J. Pendry et al, "Extremely Low Frequency Plasmons in Metallic Mesostructures," Phys. Rev. Lett. 76, 4773 (1996).

(Continued)

*Primary Examiner* — Bernarr E Gregory

(57) ABSTRACT

A system for generating, forming and receiving electromagnetic transmissions according to a dynamically selectable electromagnetic pattern, beam pattern or beam form can use a selectably altered backplane structure. A spatially dependent pattern of amplitudes and/or phases can be formed by selecting a state of the selectably altered backplane structure from a set of states. The altered backplane structure can include a movable mechanical structure that causes a set of patterns of spatially dependent amplitudes of electromagnetic energy depending on a position of the structure. A beam pattern from a set of beam patterns can be selected by selecting a state (e.g., the position) of the backplane structure that creates a set of spatially dependent amplitudes of electromagnetic energy.

37 Claims, 16 Drawing Sheets

(56) References Cited

U.S. PATENT DOCUMENTS

2012/0194399 A1 8/2012 Bily et al.

OTHER PUBLICATIONS

J. Pendry et al, "Magnetism from Conductors and Enhanced Non-Linear Phenomena," IEEE Trans. Micro. Theo. Tech. 47, 2075 (1999).
R. Shelby et al, "Experimental Verification of a Negative Index of Refraction," Science 292, 77 (2001).
V. Shalaev, "Optical negative-index metamaterials," Nature Photonics 1, 41 (2007).
D. Smith et al, "Gradient index metamaterials," Phys. Rev. E 71, 036609 (2005).
J. Pendry et al, "Controlling Electromagnetic Fields," Science 312, 1780 (2006).
D. Schurig et al, "Metamaterial Electromagnetic Cloak at Microwave Frequencies," Science 314, 977 (2006).
J. Hunt et al, "Metamaterial Apertures for Computational Imaging," Science 339, 310 (2013).

* cited by examiner

Stirrer Position G

Stirrer Position H

Stirrer Position I

SYSTEMS, METHODS AND DEVICES FOR MECHANICALLY PRODUCING PATTERNS OF ELECTROMAGNETIC ENERGY

If an Application Data Sheet ("ADS") has been filed on the filing date of this application, it is incorporated by reference herein. Any applications claimed on the ADS for priority under 35 U.S.C. § 119, 120, 121, or 365(c), and any and all parent, grandparent, great-grandparent, etc., applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)).

PRIORITY APPLICATIONS

NONE

RELATED APPLICATIONS

If the listings of applications provided herein are inconsistent with the listings provided via an ADS, it is the intent of the Applicants to claim priority to each application that appears in the Priority Applications section of the ADS and to each application that appears in the Priority Applications section of this application.

All subject matter of the Priority Applications and the Related Applications and of any and all parent, grandparent, great-grandparent, etc., applications of the Priority Applications and the Related Applications, including any priority claims, is incorporated herein by reference to the extent such subject matter is not inconsistent herewith.

TECHNICAL FIELD

The present disclosure relates to beam forming and more specifically to creating patterns of electromagnetic energy.

DETAILED DESCRIPTION

Figure 1:
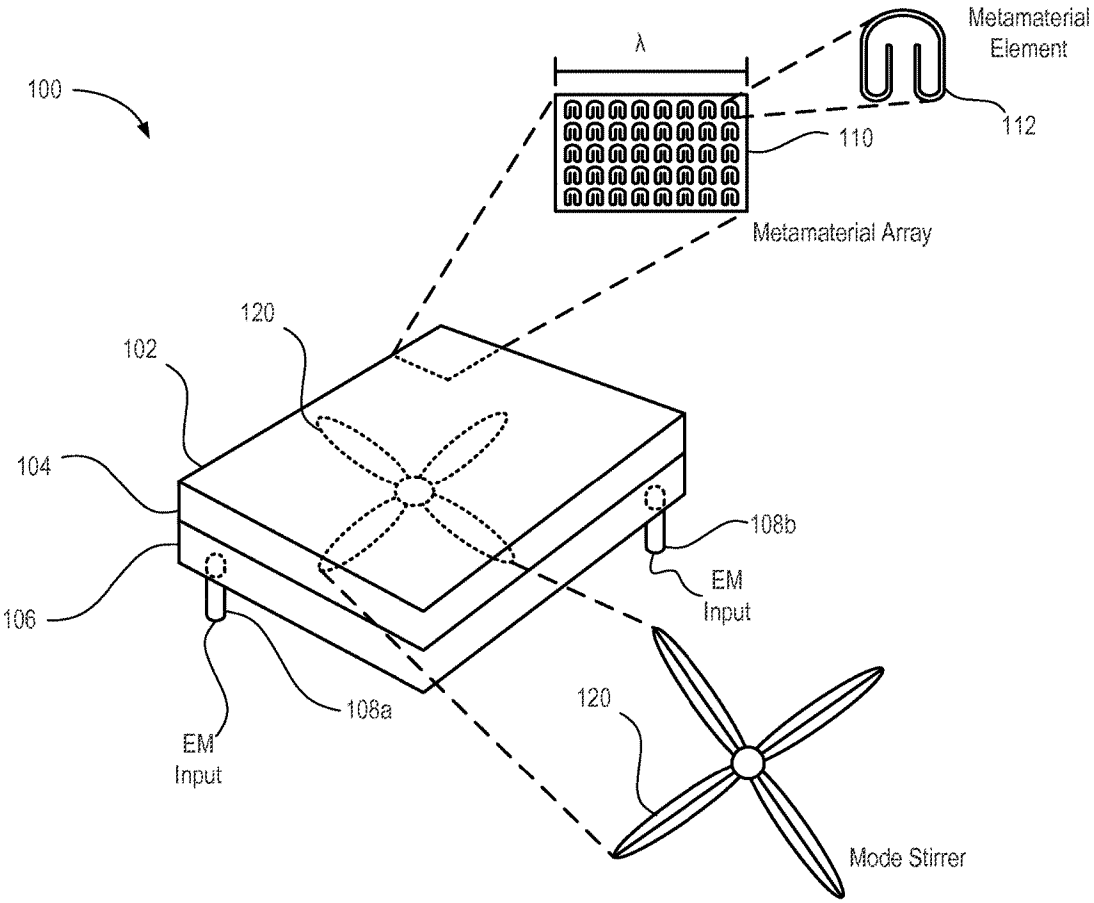
FIG. 1 is a perspective view with breakout diagrams illustrating a mechanically selectable beam pattern system consistent with embodiments disclosed herein.

A detailed description of systems and methods consistent with embodiments of the present disclosure is provided below. While several embodiments are described, it should be understood that the disclosure is not limited to any one embodiment, but instead encompasses numerous alternatives, modifications and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Techniques, apparatus and methods are disclosed that enable transmitting or receiving electromagnetic radiation having a dynamically selectable spatial pattern of amplitude and phase, or beam pattern, using a selectably altered backplane structure. A spatially dependent electromagnetic energy distribution can be formed within the backplane structure by selecting a state of the selectably altered backplane structure from a set of states. The altered backplane structure can include a movable mechanical structure that causes the electromagnetic energy distribution to change depending on a position of the structure. The energy distribution within the backplane structure can be coupled to an emitting structure over at least one surface, which can have a spatially dependent amplitude or phase transmission. The emitting structure may comprise a set of free space radiators that radiate or receive electromagnetic energy. The combination of the backplane structure and emitting structure form an electromagnetic antenna system having a pattern of far-field gain and phase response as a function of angle, hereafter referred to as a beam pattern. A beam pattern from a set of beam patterns can be selected in part by selecting a state of the backplane structure (e.g., a position of a moveable mechanical structure) that creates a set of spatially dependent amplitudes and/or phases of radiofrequency energy.

The set of beam patterns can be stochastically (e.g., randomly) generated based on a position of a mechanically alterable structure in the backplane. By selecting a state or position of the mechanically alterable structure, a far field beam pattern is selected from a set of far field beam patterns. In some embodiments, a least some of the far field beam patterns are uncorrelated.

In some embodiments, the system can be viewed as a stack of layers that contribute a pattern of spatially dependent amplitudes of radiofrequency energy to a composite pattern of spatially dependent amplitudes of radiofrequency energy. These layers can be used to apply patterns to incoming radiation or outgoing radiation. The layers can include a backplane layer with a mechanically alterable backplane structure, one or more modulation layers having a spatially-dependent transmission and/or phase shift, and a free space radiator layer. The mechanically alterable backplane structure can include rotational, oscillating or other mechanically alterable structures that alter electrical fields in the cavity (such as by interference, absorption, refraction, reflection, etc.). The modulation layer(s) and/or free-space radiator layer can include metamaterial elements that couple resonantly to the electromagnetic field. The free-space radiator layer may comprise patch radiators, dipoles, or other wavelength-scale antenna elements which individually have angle-dependent gain and/or phase behavior. As radiofrequency energy is coupled from one layer to another, any spatial pattern of transmission amplitude or phase shift applied contributes to a composite pattern of amplitude and phase response at the free-space radiator layer. The composite pattern determines the wavefront of an outgoing (transmitted) electromagnetic signal, and therefore the transmitted far-field beam pattern; similarly, the wavefront of an incoming (received) electromagnetic signal is multiplied by the composite pattern, which therefore determines the received far-field beam pattern. Depending on the embodiment, not all layers need be used or present.

In some embodiments, the backplane structure can create, at any particular frequency, a fixed spatial distribution of radiofrequency energy in the form of standing waves within a backplane region. When radiofrequency energy is input into a backplane region, the radiofrequency energy can be transmitted, obstructed, absorbed, refracted and/or reflected in the backplane based upon electromagnetic interactions with structures of the backplane structure (e.g., walls, mechanically alterable backplane structures) which form the "shape" of the backplane region. This can cause standing waves that result in a spatially dependent pattern of amplitudes and phases of radiofrequency energy, where some locations within the backplane structure have a near zero amplitude, other locations have a near maximum amplitude, and still other locations have amplitudes in between. For suitable cavity shapes and electromagnetic wavelengths, the standing wave pattern can be very sensitive to the exact cavity size and shape, including the position of any moveable element within the cavity, such that the standing wave pattern can be significantly or completely changed by changing the position of the moveable element. For example, rectangular shapes can favor certain frequencies. In another example, oval shapes can support a broader range of frequencies.

For example, a backplane cavity can include a rotating blade structure as a movable mechanical structure. By timing input of pulsed radiofrequency energy into the backplane cavity based on a rotational position of the blade structure, a spatially dependent pattern of amplitudes of radiofrequency energy within the cavity can be selected. The resulting radiofrequency energy, having been distributed into a spatial pattern of amplitude and phase, can then be coupled to free space radiators for radiation as a beam pattern of radiofrequency energy. It should also be recognized that the blade can also be used in an incoming energy embodiment to form a spatially dependent pattern of amplitudes of radiofrequency energy before detection.

In another embodiment, the backplane can be mechanically altered. For example, the backplane can include a movable wall. A diaphragm can be oscillated to provide different states of a side wall of the backplane cavity.

The backplane cavity can be effectively two-dimensional or three dimensional. In an effectively two-dimensional cavity (e.g., stripline, etc.), the cavity may support only a single mode in a third dimension. In a three-dimensional cavity, the cavity may support multiple modes in all three dimensions.

In some embodiments, a metamaterial can also be used as a layer in a beam forming system. An array of sub-wavelength elements may be configured to transmit an electromagnetic emission or receive an electromagnetic emission according to a specific pattern, direction, beam-formed shape, location, phase, amplitude and/or other transmission/reception characteristic.

For example, according to various embodiments for electromagnetic transmission according to a transmission pattern, each sub-wavelength element may be configured with an electromagnetic resonance at one of a plurality of electromagnetic frequencies. Each sub-wavelength element may also be configured to generate an electromagnetic emission in response to the electromagnetic resonance.

The sub-wavelength elements may be described as "sub-wavelength" because a wavelength of the electromagnetic emission of each respective sub-wavelength element may be larger than a physical diameter of the respective sub-wavelength element. For example, the physical diameter of one or more of the sub-wavelength elements may be less than one-half the wavelength of the electromagnetic transmission within a given transmission medium, such as a quarter wavelength or one-eighth wavelength. In some embodiments, the physical diameter may be less than one-half of the wavelength divided by the sine of theta, where theta is the maximum beam steering angle with respect to the normal of the array of sub-wavelength elements.

A beam forming controller may be configured to cause radiofrequency energy to be transmitted by one or more radiofrequency energy sources at select electromagnetic frequencies to resonate with a select subset of the sub-wavelength elements to cause the resonating sub-wavelength elements to generate electromagnetic emissions according to a selectable electromagnetic transmission pattern. The radiofrequency energy may be conveyed to the various sub-wavelength elements via a common port, such as a waveguide or free space.

Similarly, electromagnetic systems may receive radiofrequency energy via a selected subset of the sub-wavelength elements at a given time. Accordingly, the electromagnetic system may receive electromagnetic transmissions according to a specific electromagnetic receiving pattern, beam pattern, direction, focus, location or other electromagnetic transmission characteristic.

In some embodiments, sub-wavelength elements can be created with different frequency sensitivities. For example, sub-wavelength elements can be created with a sensitivity to a distribution of frequencies (such as a random distribution created with a loosening of quality control). Each of the sub-wavelength elements in a random pattern is activated by a different frequency. In one example, a first pattern of energy results when a feed of 76.9 gigahertz energy is coupled to the sub-wavelength elements. At 77.1 gigahertz, a second pattern of energy is emitted by the sub-wavelength elements. At 77.3 gigahertz, a third pattern is emitted by the sub-wavelength elements. This sensitivity can be used by sweeping through a set of frequencies and measuring return values for each pattern. (These return values can then be used in compressive imaging, discussed below.)

In some embodiments, the beam forming or receiving system can be used in compressive imaging applications (also known as compressive sensing). In a compressive imaging application, a sensor with a smaller resolution than a desired resolution is used to sense multiple patterns of energy from an environment. These sensed multiple patterns can then be combined to create an image of the environment that has a larger resolution than the sensor. The patterns can be formed in outgoing energy toward the environment or incoming energy from the environment.

For example, a pattern of radiation can be formed and directed at the environment. A spatially dependent amplitude (first pattern) can be formed within a backplane structure that is configured to couple radiofrequency energy to sub-wavelength elements. The first pattern can be presented to the sub-wavelength elements, which then create a wavefront to be sent out to free space radiators. By causing the spatially dependent amplitude to be coupled to the sub-wavelength elements, a pattern of radiation can be formed (beam pattern). By coupling two patterns, a larger set of patterns can be formed than by either pattern alone (as the set creation is multiplicative). The radiation pattern can then be detected by a sensor. Multiple sensed radiation patterns can then be processed, using compressive imaging techniques, into a single image.

In another example, incoming radiation can be altered by a set of patterns for use in compressive imaging. Incoming radiation can be coupled to a receiving layer which uses a first spatially dependent pattern to couple incoming energy to a backplane structure. The backplane structure can then apply a second spatially dependent pattern to form a spatially dependent distribution of amplitude and phase. The electromagnetic signal at a particular location in the spatially dependent distribution can then be coupled to a detector. The distribution, and therefore the spatial pattern of response to an incoming signal, can then be changed by altering the backplane structure. Multiple applied patterns can then be detected by the detector. The detected patterns can then be processed using compressive imaging techniques to form an image.

The resolution of a sensor and a number of a set of beam patterns can be varied depending on the embodiment. In some embodiments, a sensor is a single sensor and the beam patterns are varied. In one embodiment, a first spatially dependent pattern (from a backplane structure) and a second spatially dependent pattern (from a transmission layer) combine to form a set of at least 100 beam patterns. For example, a first spatially dependent amplitude pattern of 10 patterns can combine with a second spatially dependent amplitude pattern of 10 patterns to cause an output of 100 different beam patterns released by an illumination system. In some embodiments of compressive imaging, approximately 100 or more beam patterns are needed to construct an image.

In some embodiments, the meta-material layer can be controlled by a grid of elements. In one embodiment, the grid of elements is a liquid crystal grid (LCG, sometimes referred to as a matrix) in which a liquid crystal element can alter behavior of a transmission layer element (such as a metamaterial element). In another embodiment, the grid of elements can selectively vary a transmission coefficient of each element of the grid to tune energy toward or away from an antenna frequency.

In one embodiment, electromagnetic energy from the backplane structure is coupled to an array of antenna elements, which, if uniformly excited, would generate a particular electromagnetic beam pattern. By coupling a pattern of electromagnetic energy from the backplane structure modulated by the electromagnetic energy, multiplied by the pattern of energy from the backplane, a far field beam pattern is produced by the antenna array. The far field beam pattern is a convolution of the pattern that the antenna elements generate with the pattern that the electromagnetic energy generates if radiated by a uniform array of antenna elements.

It should be recognized that while patterns of amplitudes of radiofrequency energy are discussed for clarity, patterns of phases of radiofrequency energy and/or patterns of amplitudes of radiofrequency energy, phases of radiofrequency energy, or spatial distributions of intensities can also be used in embodiments. In addition, while embodiments discussed below focus on radiofrequency energy for clarity, it should be recognized that other electromagnetic energy can also be used.

FIG. 1 is a perspective view with breakout diagrams illustrating a mechanically selectable beam pattern system 100. The system 100 can include multiple layers: a backplane layer 106, and a metamaterial layer 102. Each layer can contribute a pattern of amplitudes of electromagnetic energy to create a composite pattern of radiofrequency energy selectable from a set of composite patterns. Radiofrequency energy can be introduced into the backplane layer 106, which applies a first spatial pattern of amplitudes (and/or phases) to the input radiofrequency energy. The first spatial pattern of amplitudes (and/or phases) of radiofrequency energy can be coupled to the metamaterial layer 102, which can apply a second spatial pattern of amplitudes (and/or phases) to the radiofrequency energy coupled from the backplane. The resulting radiofrequency energy from the metamaterial layer 102 can be radiated as a beam pattern selected based at least in part on the first spatial pattern of amplitudes and second spatial pattern of amplitudes.

The backplane cavity 106 can include one or more electromagnetic inputs 108*a* and 108*b* (or emitters) and a movable mechanical structure that can be used to select a pattern of amplitudes of radiofrequency energy. The movable mechanical structure can alter the spatial distribution of the electrical and magnetic field strength in the backplane cavity depending on a position of the movable mechanical structure (which can also be referred to randomizing modes in the backplane cavity). In addition, multiple electromagnetic inputs 108*a* and 108*b* can be used to further alter the spatial distribution of the electrical and magnetic field strength in the backplane cavity by selecting which inputs are active phase differences, amplitude differences and other signal differences between active inputs. These patterns can be stochastic patterns.

In the embodiment shown, a blade-shaped mode stirrer 120 (or tuner) is used to achieve a selected pattern of amplitudes of radiofrequency energy depending on a rotational position of the mode stirrer 120. In some embodiments, a pattern of amplitudes of radiofrequency energy is selected from a set of patterns of amplitudes of radiofrequency energy by timing input radiofrequency energy to a rotational position of the mode stirrer 120. The resulting pattern of amplitudes of radiofrequency energy can then be coupled to the metamaterial layer 102.

The metamaterial layer 102 can receive radiofrequency energy from the transmission layer 104, apply a second pattern of amplitudes of radiofrequency energy and cause the emission of a beam pattern. In the embodiment shown, the metamaterial layer 102 can include a metamaterial array 110 of metamaterial elements 112. In one embodiment, a pattern of metamaterial elements is sensitive to a set of frequencies of radiofrequency energy. Metamaterial elements 112 in a second pattern sensitive to incoming frequencies can resonate with the received radiofrequency energy from the transmission layer 104 and cause a beam pattern to be emitted. This second pattern can be a composite pattern of the first pattern formed by the mode stirrer 120 and the second pattern formed by the metamaterial layer 102. The composite pattern corresponds to the beam pattern emitted by the beam pattern system 100.

The application of the second pattern to the first pattern forms a composite pattern, allowing for a multiplicative effect of the number of beam patterns in a set of beam patterns that can be formed. For example, a set of 10 rotational positions of the mode stirrer 120 can be combined with a set of 10 patterns from the metamaterial layer 102 to form 100 composite patterns. In some embodiments, all 100 composite patterns can be unique. In other embodiments, not all 100 composite patterns are unique.

For example, radiofrequency energy having a frequency of 76.9 gigahertz is input into the backplane cavity 106 through electromagnetic input 108*a*. At the time of input, the blade structure 120 is orthogonal to the electromagnetic input 108*a*, causing a first pattern of amplitudes of radiofrequency energy to be formed in the backplane structure. The first pattern of amplitudes of radiofrequency energy is coupled to the metamaterial layer 102. Due to manufacturing variations, only a portion (e.g., a set) of the metamaterial elements 112 of the metamaterial array 110 resonates at 76.9 gigahertz. The metamaterial elements 112 that resonate form a third pattern of amplitudes of radiofrequency energy. The metamaterial elements 112 that are capable of resonating at 76.9 gigahertz and that receive radiofrequency energy from the transmission layer 104 resonate and cause a beam pattern of radiofrequency energy to be formed and emitted.

Other patterns can be further refined by selecting configurations of each layer. The backplane layer 106 can be configured in several ways. In some embodiments, multiple electromagnetic inputs 108*a* and 108*b* are activated, which causes electromagnetic interference to form a pattern of electromagnetic amplitudes in the backplane cavity. In an embodiment, position of the blade structure 120 can be selected, which causes electromagnetic interference to form a pattern of electromagnetic amplitudes in the backplane cavity. In other embodiments, elements of the blades (e.g., slot radiators, grounding of blade areas (like use of PIN diodes), etc.) can be used to further increase a number of, diversity of or physical difference between patterns created by the blade structure 120.

It should be recognized that a rotating "blade structure" is not required, but is an example of a mechanical embodiment for selecting a pattern of amplitudes or phases of radiofrequency energy. Other embodiments include oscillating vanes, diaphragms, mechanically alterable slot radiators, etc. In some embodiments, a blade structure can be used in practice as a cheap and reliable way of selecting a pattern of amplitudes or phases of radiofrequency energy. For example, the blade structure's moving parts are placed in a sealed volume. In another embodiment, and particularly for short wavelengths, a resonant oscillating structure such as a vane or diaphragm on flexures provides enough change in a cavity shape (i.e., its electromagnetic pattern), while eliminating bearings. In another embodiment, a non-contact structured switch-like structure can open and close multiple ports (e.g., by opening or capacitively shorting slot radiators) as the mechanical structure is rotated or oscillated.

FIGS. 2A, 2B, 2C, 2D and 2E show formation of wavefronts 202*a*, 202*b*, 202*c*, 202*d* and 202*e* using sub-wavelength metamaterial elements 204 and 206. As sub-wavelength metamaterial elements 204 and 206 are less than a wavelength of emitted radiofrequency energy, multiple sub-wavelength metamaterial elements 204 and 206 can be used to create the wavefront 202*a*, 202*b*, 202*c*, 202*d* or 202*e* that forms an emitted electromagnetic wave. FIGS. 2A, 2B, 2C, 2D and 2E show a metamaterial layer 208 from a side view where incoming radiofrequency energy is received from the bottom and wavefronts 202*a*, 202*b*, 202*c*, 202*d* and 202*e* are formed at the top. In some embodiments, the arriving radiofrequency energy to sub-wavelength metamaterial elements 204 and 206 can be controlled by a transmission layer (e.g., controlling which sub-wavelength elements become activated by receiving radiofrequency energy from the transmission layer). Four sub-wavelength metamaterial elements 204 and 206 form a wavelength of the emitted energy. In the embodiment, the sub-wavelength metamaterial elements 204 and 206 are activated in a linear fashion to form a wavefront 202*a*, 202*b*, 202*c*, 202*d* or 202*e* that moves nearly horizontally.

Figure 2A:
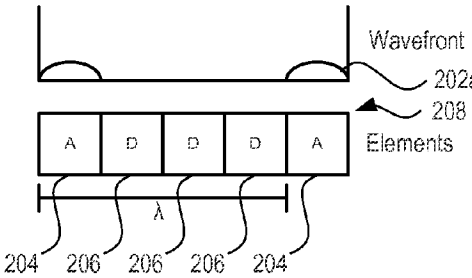
FIG. 2A is a schematic diagram illustrating a first state of wavefront construction with a metamaterial consistent with embodiments disclosed herein.

In the embodiment shown in FIG. 2A, active elements 204 receive radiofrequency energy from a transmission layer below, while inactive elements 206 do not receive radiofrequency energy. The active elements 204 resonate and create a wavefront 202*a* of an electromagnetic emission.

Figure 2B:
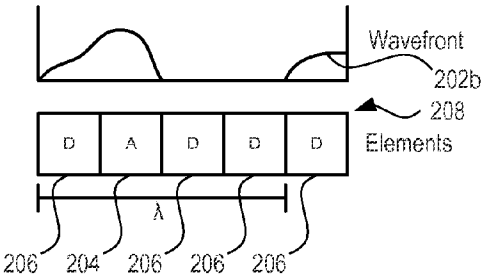
FIG. 2B is a schematic diagram illustrating a second state of wavefront construction with a metamaterial consistent with embodiments disclosed herein.
Figure 2C:
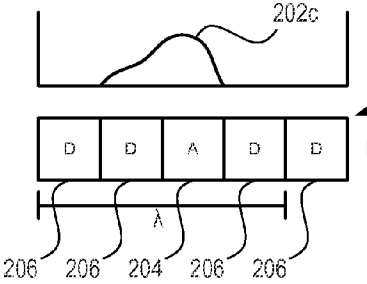
FIG. 2C is a schematic diagram illustrating a third state of wavefront construction with a metamaterial consistent with embodiments disclosed herein.
Figure 2D:
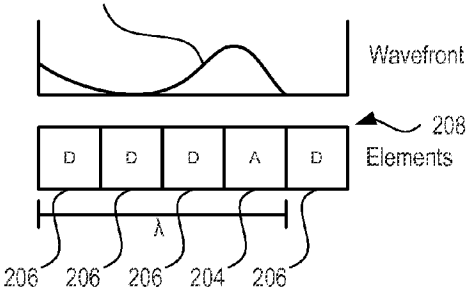
FIG. 2D is a schematic diagram illustrating a fourth state of wavefront construction with a metamaterial consistent with embodiments disclosed herein.
Figure 2E:
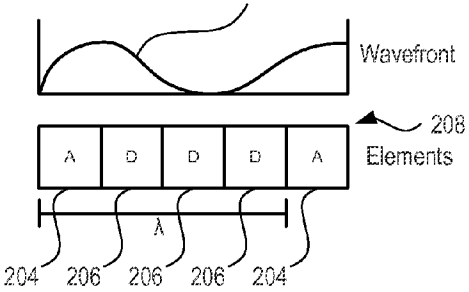
FIG. 2E is a schematic diagram illustrating a fifth state of wavefront construction with a metamaterial consistent with embodiments disclosed herein.

Moving to FIG. 2B, an active element 204 to the left of the previously active element receives radiofrequency energy from a transmission layer below, while inactive elements 206 do not receive radiofrequency energy. The active element 204 resonates and creates a wavefront 202*b* of an electromagnetic emission that is now centered over the active element 204. This process repeats in FIGS. 2C, 2D and 2E, where the active element 204 to the left of the previously active element receives radiofrequency energy from a transmission layer below, while inactive elements 206 do not receive radiofrequency energy. The active element 204 resonates and creates a wavefront 202*c*, 202*d* or 202*e* of an electromagnetic emission that is now centered over the active element 204. A resulting electromagnetic wave is formed from the wavefronts 202*a*, 202*b*, 202*c*, 202*d* and 202*e* and is moving in a direction having components parallel to and away from the metamaterial layer 208.

In one embodiment, a pattern of metamaterial elements is sensitive to a set of frequencies of radiofrequency energy. These metamaterial elements 204 and 206 that are sensitive to incoming frequencies can resonate with the received radiofrequency energy from a transmission layer and cause a beam pattern to be emitted. This allows a metamaterial layer 208 to contribute a pattern to a composite pattern that forms a beam pattern.

It should also be recognized that metamaterial elements can be used for both outgoing and incoming radiation of radiofrequency energy. In the embodiment described above, radiofrequency energy is coupled to the metamaterial layer 208, which forms a wavefront to be emitted into free space. In another embodiment, electromagnetic radiation (e.g., electromagnetic waves) can be received from free space and cause the sub-wavelength metamaterial elements to resonate and couple the received radiofrequency energy into a transmission layer.

Figure 3A:
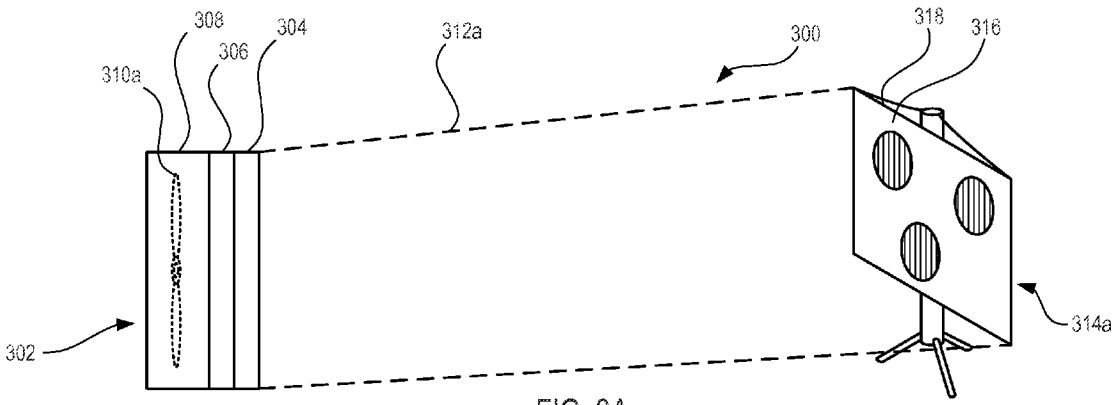
FIG. 3A is a diagram of a selectable beam pattern illumination system forming a first pattern consistent with embodiments disclosed herein.
Figure 3B:
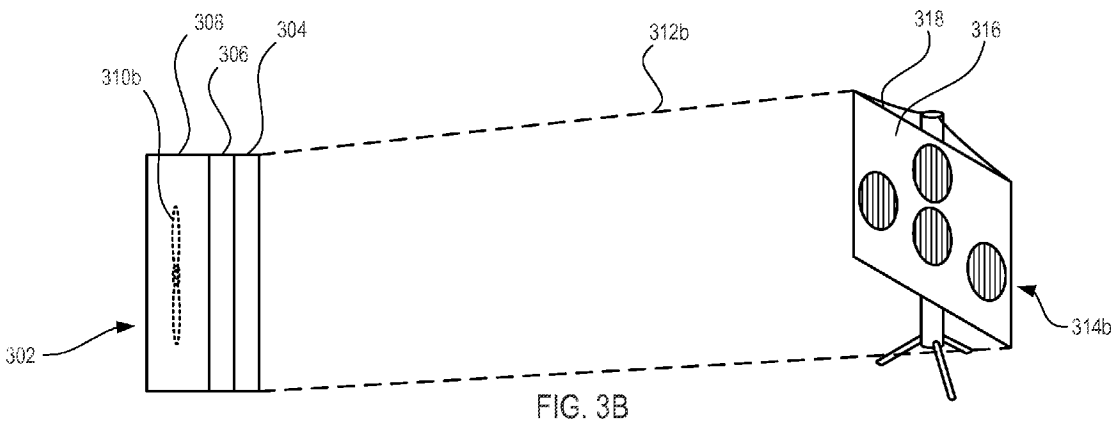
FIG. 3B is a diagram of a selectable beam pattern illumination system forming a second pattern consistent with embodiments disclosed herein.

FIGS. 3A and 3B are diagrams 300 that show a selectable beam pattern illumination system 302 forming beam patterns 314*a* and 314*b*. FIG. 3A shows the beam pattern illumination system 302 having a first configuration of a backplane structure 308, a transmission layer 306 and an emission layer 304 (such as a metamaterial layer 304). FIG. 3B shows the beam pattern illumination system 302 having a second configuration of the backplane cavity 308, the transmission layer 306 and the metamaterial layer 304. The circles on the surface 316 represent a beam pattern projected by the beam pattern illumination system 302.

The beam pattern 314*a* or 314*b* is formed by input radiofrequency energy modified by a first pattern of amplitudes of radiofrequency energy applied by the backplane cavity 308, a second pattern of amplitudes of radiofrequency energy applied by the transmission layer 306 and a third pattern of amplitudes of radiofrequency energy applied by the emission layer 304. The resulting radiofrequency energy formed by the applied patterns to input radiofrequency energy forms a beam 312*a* or 312*b*, which can be used to illuminate an environment 316 (such as a surface shown in FIGS. 3A and 3B) with a beam pattern 314*a* or 314*b*. In FIG. 3A, the beam pattern 314*a* is shown as dependent on a first rotational position of a movable electromagnetically responsive element 310*a* (such as a blade structure). In FIG. 3B, the beam pattern 314*b* is shown as dependent on a second rotational position of the movable electromagnetically responsive element 310*b*. In some embodiments, a rotational position of the movable electromagnetically responsive element 310*a* and 310*b* selects a different beam pattern 314*a* or 314*b* from a set of beam patterns, given the patterns applied by the transmission layer 306 and emission layer 304 remain the same.

A series of beam patterns 314*a* and 314*b* can be used in applications such as compressive imaging. In a compressive imaging application, a sensor with a smaller resolution than a desired resolution is used to sense multiple patterns of energy from an environment. These sensed multiple patterns can then be combined to create an image of the environment that has a larger resolution than the sensor. A reflected radiation pattern can then be detected by a sensor. Multiple sensed radiation patterns can then be processed, using compressive imaging techniques, into a single image. The single image can have a higher resolution than the sensor due to the combination of beam patterns highlighting specific areas of the environment. While this example in FIGS. 3A and 3B is described as an outgoing illumination using beam patterns, it should be recognized that the patterns can also be formed on incoming return energy from the environment onto a sensor.

For example, for many M×N matrices Φ, a unique K-sparse solution x to the equation $\Phi x^* = y$ can be recovered. N must be much larger than K. However, M (the number of measurements) can be a little larger than K. M can be approximately K log N/K. A K-sparse solution is found by $l_1$-minimization, which can be equivalent to $l_0$-minimization under assumptions on the measurement matrix Φ (such as a random plane that passes through a vertex is very likely to miss an interior of a cross polytope). Random matrices Φ are very likely to satisfy these assumptions. (See, e.g., Mackenzie, Dana (2009), "Compressed sensing makes every pixel count," *What's Happening in the Math Sciences, AMS,* 114-127.) Image reconstruction from measurements can include linear programming techniques for solving $l_1$-minimization, iterative Orthogonal Matching Pursuit (OMP), Matching Pursuit (MP), Tree Matching Pursuit (TMP), group testing using Hamming code construction, Chaining Pursuit (CP), sudocode, subspace pursuit, S-POCS, Smoothed L0 norm, etc.

In some embodiments, a compressive imaging scheme has an advantage in that it is not necessary to completely suppress all but one orthogonal beam pattern for each pattern. If the beam patterns are a known superposition of orthogonal patterns with enough different weightings, individual orthogonal patterns can be extracted.

Figure 4:
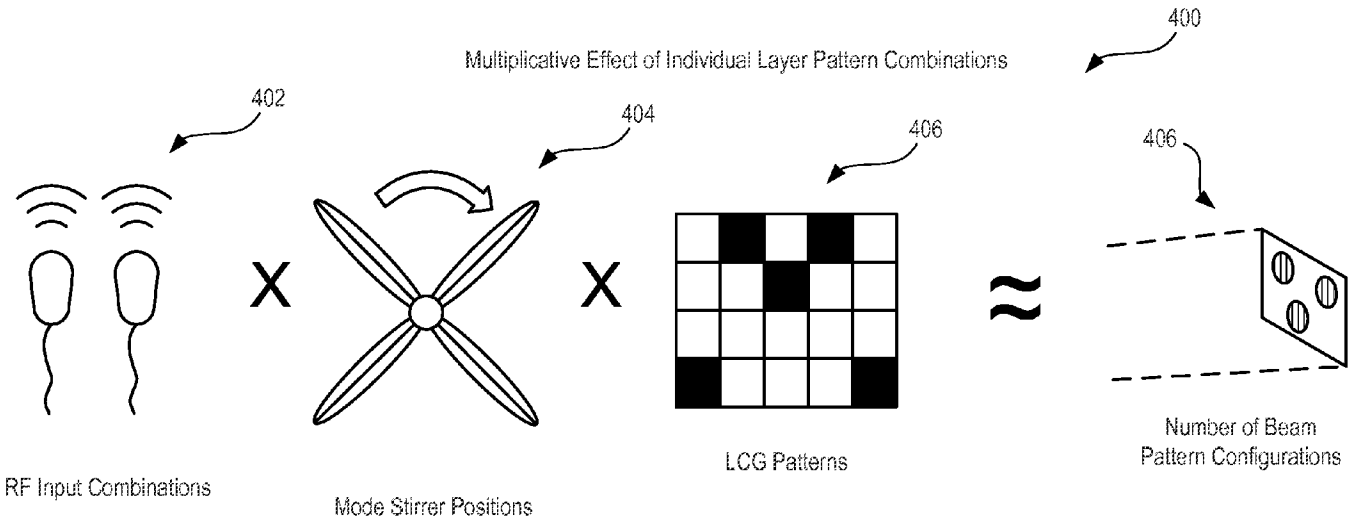
FIG. 4 is a diagram illustrating a multiplicative effect of combining patterns from multiple layers consistent with embodiments disclosed herein.

FIG. 4 is a diagram 400 illustrating a multiplicative effect of combining patterns from multiple layers consistent with embodiments disclosed herein. A beam pattern can be selected by selecting a configuration of radiofrequency energy inputs 402, mode stirrer 404, LCG pattern 406 and other configurations (e.g., metamaterial frequency sensitivity). For example, radiofrequency energy inputs 402 can be configured by a number of active inputs, frequency of active inputs, amplitude of active inputs and/or phase of active inputs. Mode stirrer configuration can include mode stirrer rotational position 404 and/or mode stirrer electrical changes (such as electrically grounding slot radiators, mechanically altering slot radiator openings, etc.). An LCG can be configured by selecting an opacity (or transparency) for elements of the LCG, which controls a metamaterial layer by tuning energy toward or away from an antenna frequency. Each configuration contributes a pattern of radiofrequency energy (such as a spatial pattern of amplitudes, phases) to a composite pattern that correlates to a beam pattern in a set of beam pattern configurations. These configurations have a multiplicative effect as to a size of the set of beam pattern configurations. For example, a set of five radiofrequency energy input configurations combines with a set of six mode stirrer positions and a set of seven LCG patterns 406 (the LCG pattern controlling metamaterial resonators) to form a total of 210 composite patterns. Depending on the embodiment, however, some beam patterns can be considered duplicative. For example, a rotational position of a symmetrical mode stirrer can produce a similar or identical pattern along a line of symmetry. For example and like stated above, a set of five radiofrequency energy input configurations combines with a set of six mode stirrer positions and a set of seven LCG patterns to form a total of 210 composite patterns. However, the 210 composite patterns have 50 patterns that are viewed as duplicative (e.g., too close to another composite pattern to provide sufficiently different data). This would result in 150 unique patterns.

Figure 5:
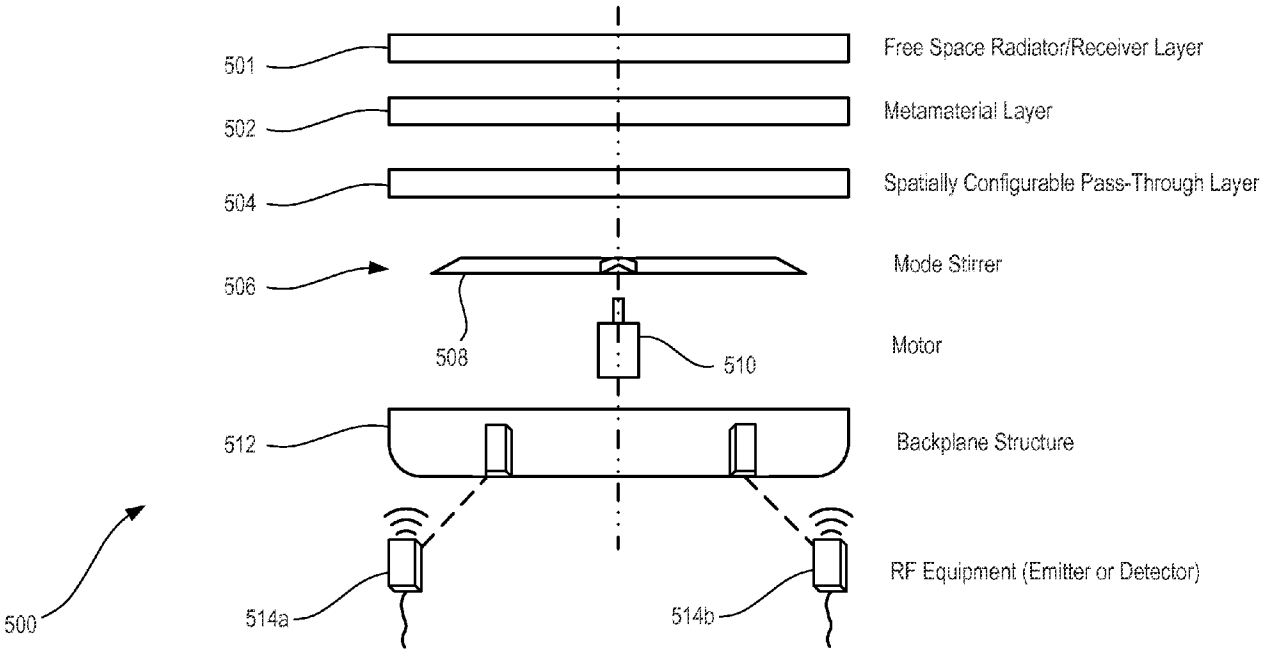
FIG. 5 is an exploded view illustrating a mechanically selectable beam pattern system consistent with embodiments disclosed herein.

FIG. 5 is an exploded view illustrating a mechanically selectable beam pattern system 500. The system 500 includes one or more radiofrequency (RF) equipment 514*a* and 514*b*, a backplane structure 512, a motor 510, a mode stirrer 506, a spatially configurable pass-through layer 504, a metamaterial layer 502 and a free space receiver or radiator layer 501. Depending on the embodiment, patterns can be applied to incoming radiation or outgoing radiation.

In an incoming radiation embodiment, radiation arrives into the free space receiving layer 501. The free space receiving layer 501 couples the radiation to the metamaterial layer 502. The metamaterial layer 502 can include a set of metamaterial elements that are sensitive to a frequency of radiation. The set of metamaterial elements forms a pattern of amplitudes of energy that can couple received radiation to the spatially configurable pass-through layer 504. The spatially configurable pass-through layer 504 can include a first set of elements, in which some elements are approximately transparent and other elements are approximately opaque. The set of elements forms a pattern of amplitudes of energy that is coupled to the mode stirrer 506. A rotational position of the mode stirrer 506 causes blades 508 to interact with energy received from the spatially configurable pass-through layer 504 into the backplane structure 512. The rotational position can be provided by the motor 510. The interaction forms a composite pattern from all the previous patterns, which can be detected by one or more sensors 514*a* and 514*b* (such as a detector, e.g., an amplitude detector, FM detector, etc.).

Depending on the embodiment, the mode stirrer can be in motion or moved to a position. In one embodiment, the mode stirrer is in constant motion. A timing of incoming radiation selects a rotational position of the mode stirrer, which in turn, selects a pattern of amplitudes of radiofrequency energy. In another embodiment, the motor is a stepper motor, which is used to move the mode stirrer to a rotational position and then stopped. A pattern of amplitudes of radiofrequency energy can be selected, and the stepper motor is moved to the rotational position that represents the selected pattern. In some embodiments, a stepper motor is used to iterate through rotational positions as measurements are taken.

In an outgoing radiation embodiment, radiofrequency energy is input into the backplane structure 512. A rotational position of the mode stirrer 506 in the backplane cavity 512 causes blades 508 to interact with energy received from the RF emitters 514*a* and 514*b* within the backplane structure 512. The rotational position can be provided by a motor 510. The interaction of the mode stirrer 506 with the input radiofrequency energy forms a pattern of amplitudes of radiofrequency energy. The backplane structure 512 can couple the modified radiofrequency energy to a spatially configurable pass-through layer 504. The spatially configurable pass-through layer 504 can include a first set of elements in which some elements are approximately transparent and other elements are approximately opaque. The set of elements controls the metamaterial layer 502. The metamaterial layer 502 can include a set of metamaterial elements that are sensitive to a frequency of radiation. The set of metamaterial elements forms a pattern of amplitudes of energy that can couple received energy to free space radiators 501. The free space radiators 501 can radiate the electromagnetic energy into space.

It should be recognized that not all layers and/or configurations are used in every embodiment. For example, a metamaterial layer can couple received radiofrequency energy without application of a pattern. In another example, a spatially configurable pass-through layer can be omitted. In one example, a single RF emitter or detector is used.

Patterns of electromagnetic amplitudes can be generated. In some embodiments, a blade structure can be used as a way of selecting a pattern of amplitudes or phases of radiofrequency energy. For example, the blade structure's moving parts are placed in a sealed volume transparent to RF energy. The sealed volume can provide a less expensive and potentially reliable way to operate the blade structure as a mode stirrer.

Figure 6:
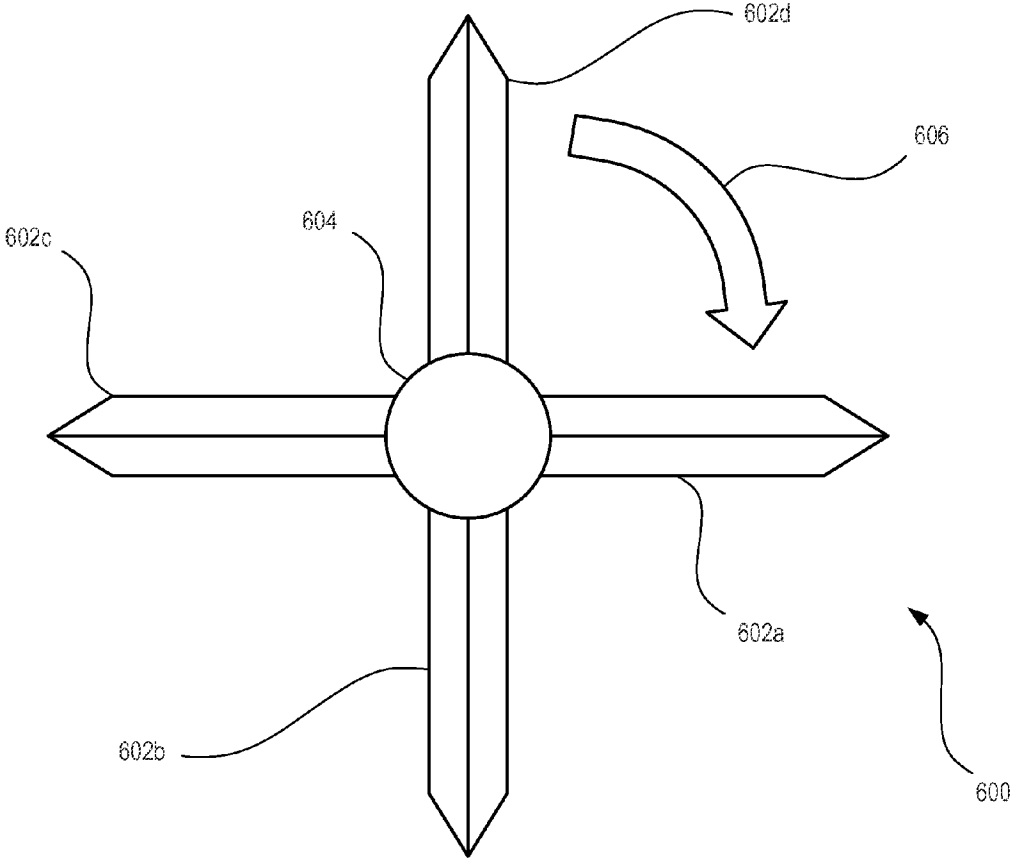
FIG. 6 is a top view of a reflective blade style electromagnetic pattern generator consistent with embodiments disclosed herein.

FIG. 6 is a top view of a reflective blade style electromagnetic pattern generator 600 consistent with embodiments disclosed herein. In the embodiment shown, the electromagnetic pattern generator 600 is a mode stirrer in blade structure having a shape similar to a fan. The electromagnetic pattern generator 600 includes a plurality of projections 602*a*, 602*b*, 602*c*, 602*d* (e.g., blades, reflectors, etc.) that extend radially from a central rotational support 604. When used in conjunction with a backplane region (e.g., a backplane structure such as a backplane cavity), the electromagnetic pattern generator 600 can be rotated (shown by arrow 606) to select a pattern of amplitudes of radiofrequency energy in the backplane region. The projections can cause a pattern of amplitudes of radiofrequency energy through reflection, refraction, absorption, other electrical interference or a combination thereof. The structure can also be modified so that reflection, refraction, absorption or other properties can be altered by movement of the structure and/or electrical changes (such as grounding).

In some embodiments, the mode stirrer can include one or more levels. For example, a first level can include four projections 602*a*, 602*b*, 602*c*, 602*d* as shown. A second level can include four more projections rotated at a 45 degree angle and set below the four projections 602*a*, 602*b*, 602*c*, 602*d*.

Figure 7:
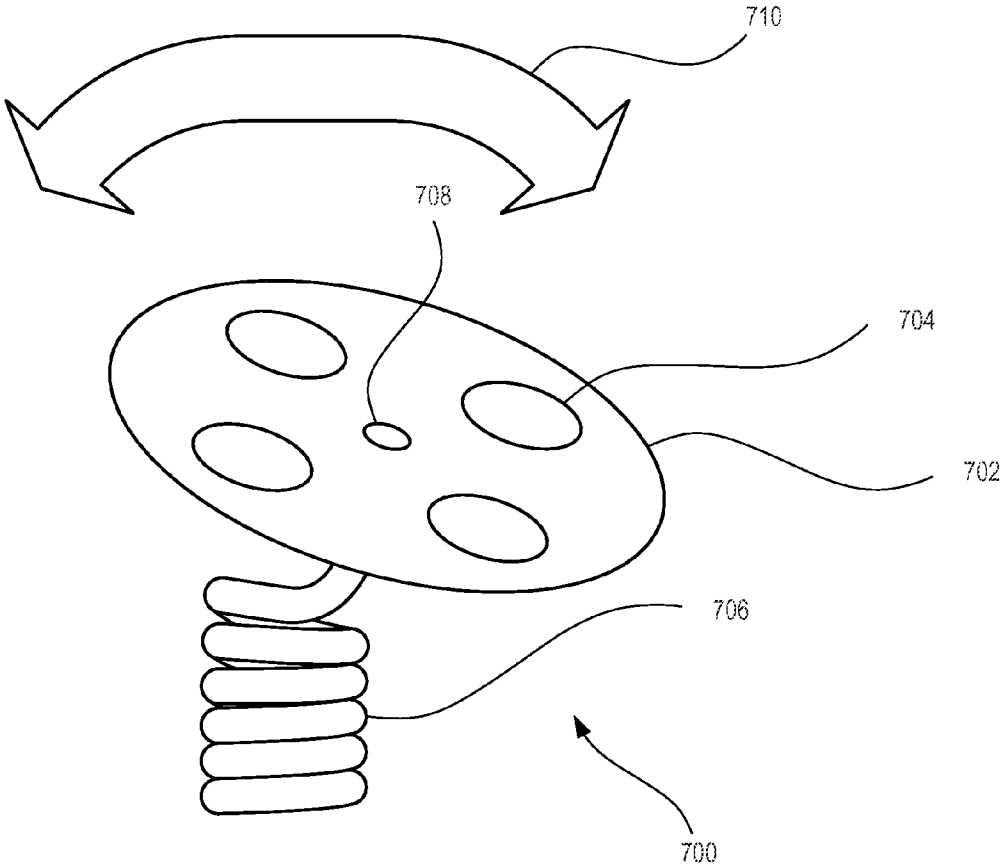
FIG. 7 is a perspective view of a mechanically oscillating electromagnetic pattern generator consistent with embodiments disclosed herein.

FIG. 7 is a perspective view of a mechanically oscillating electromagnetic pattern generator 700 consistent with embodiments disclosed herein. In the embodiment shown, the mechanically oscillating electromagnetic pattern generator 700 can be a disc 702 with holes 704. The disc 702 can be attached to a flexible stem 706 (e.g., spring, rod, tube, beam, etc.) at attachment point 708. A periodic driving element (such as a magnetic coil, motor with a cam or eccentric weight, or piezoelectric element) can connect to the flexible stem 706 and cause resonant movement of the stem (shown by arrow 710).

In another embodiment, the stem 706 is rigid and oscillation is caused through movement of the stem 706. For example, the stem 706 can be attached to a diaphragm that causes movement of the rigid stem 706. When used in conjunction with a backplane region (e.g., a backplane structure such as a backplane cavity), the mechanically oscillating electromagnetic pattern generator 700 can be oscillated (shown by arrow 710) causing a pattern of amplitudes of radiofrequency energy in the backplane region for a position of the mechanically oscillating electromagnetic pattern generator 700. The disc 702 and holes 704 can cause a pattern of amplitudes of radiofrequency energy through reflection, refraction, absorption, other electrical interference or a combination thereof.

In another embodiment, and particularly for short wavelengths, a resonant oscillating structure such as a vane or diaphragm on flexures provides enough change in a cavity shape (i.e., its electromagnetic pattern), while eliminating bearings.

Figure 8:
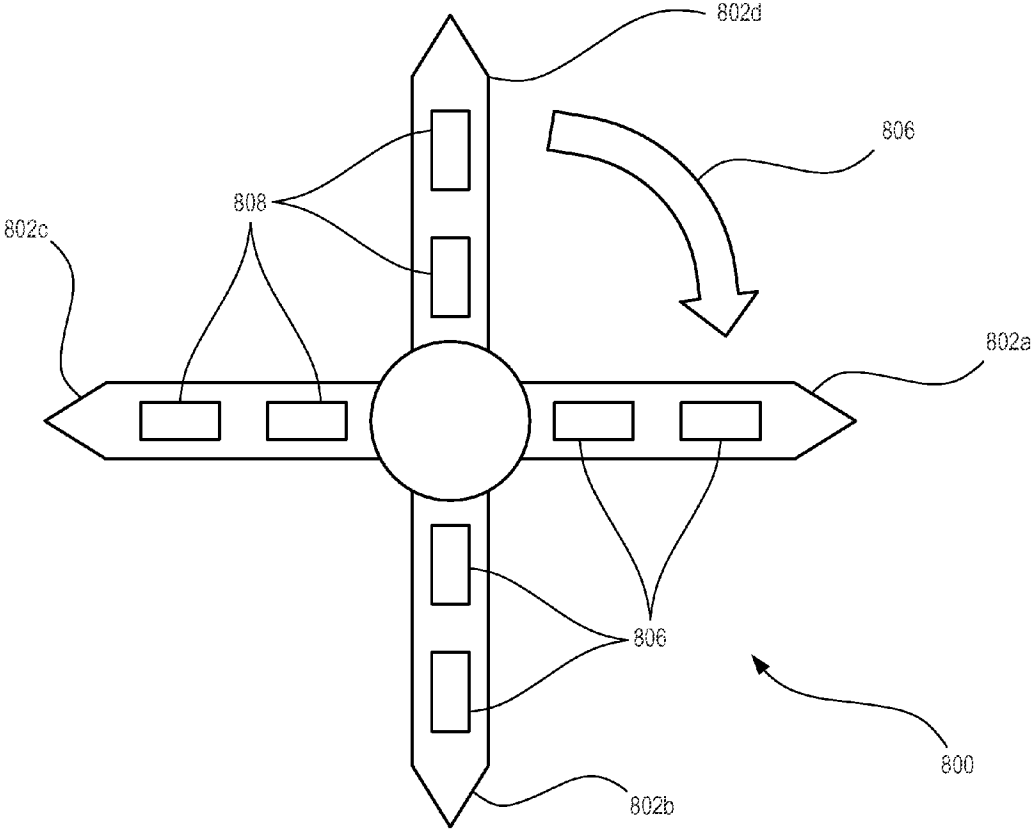
FIG. 8 is a top view of a reflective blade style electromagnetic pattern generator with slot radiators consistent with embodiments disclosed herein.

The shapes of the electromagnetic pattern generators of FIGS. 6 and 7 can be further enhanced with pattern enhancing characteristics. For example, FIG. 8 is a top view of a reflective blade style electromagnetic pattern generator 800 with slot radiators 808 consistent with embodiments disclosed herein. The slot radiators can be further configurable, such as alteration of shape, selectively electrically groundable and/or selectably openable/closable. By altering the characteristics of individual and/or groups of slot radiators, additional patterns of amplitudes of radiofrequency energy can be created by using a rotational position of the reflective blade style electromagnetic pattern generator 800 with the slot radiators.

In the embodiment shown, the electromagnetic pattern generator 800 includes a plurality of projections 802*a*, 802*b*, 802*c*, 802*d* that extend radially from a central rotational support. The projections 802*a*, 802*b*, 802*c*, 802*d* include slot radiators 808. When used in conjunction with a backplane region (e.g., a backplane structure such as a backplane cavity), the electromagnetic pattern generator 800 can be rotated (shown by arrow 806) to select a pattern of amplitudes of radiofrequency energy in the backplane region. The projections can cause a pattern of amplitudes of radiofrequency energy through reflection, refraction, absorption, other electrical interference or a combination thereof.

In another embodiment, a non-contact structured switch-like structure can open and close multiple ports (e.g., by opening or capacitively shorting slot radiators) as the mechanical structure is rotated or oscillated.

In yet another embodiment, the electromagnetic pattern generator 800 includes conductive portions and non-conductive portions. For example, a blade or disc can include copper conductive patches. In another example, a blade or disc includes dielectric portions. Movement of the electromagnetic pattern generator 800 changes electromagnetic characteristics of a portion of the cavity. In some embodiments, the conductive patch can create a short when it comes into contact with another conductive patch in the cavity.

In some embodiments, a variable electromagnetically active element is configured to change a mode of the radiofrequency energy within the backplane structure.

Figure 9:
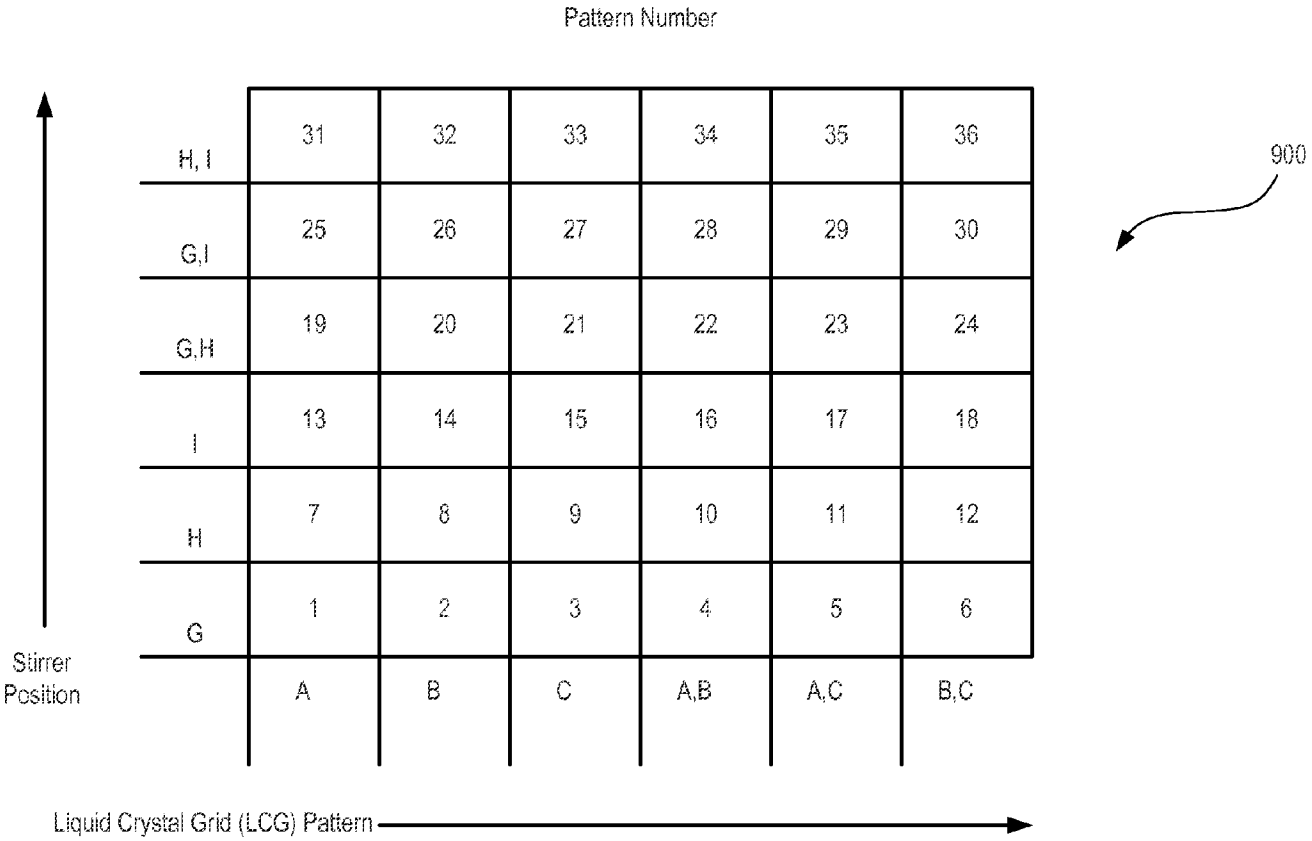
FIG. 9 is a table identifying patterns of a reflective blade style electromagnetic pattern generator consistent with embodiments disclosed herein.
Figure 10:
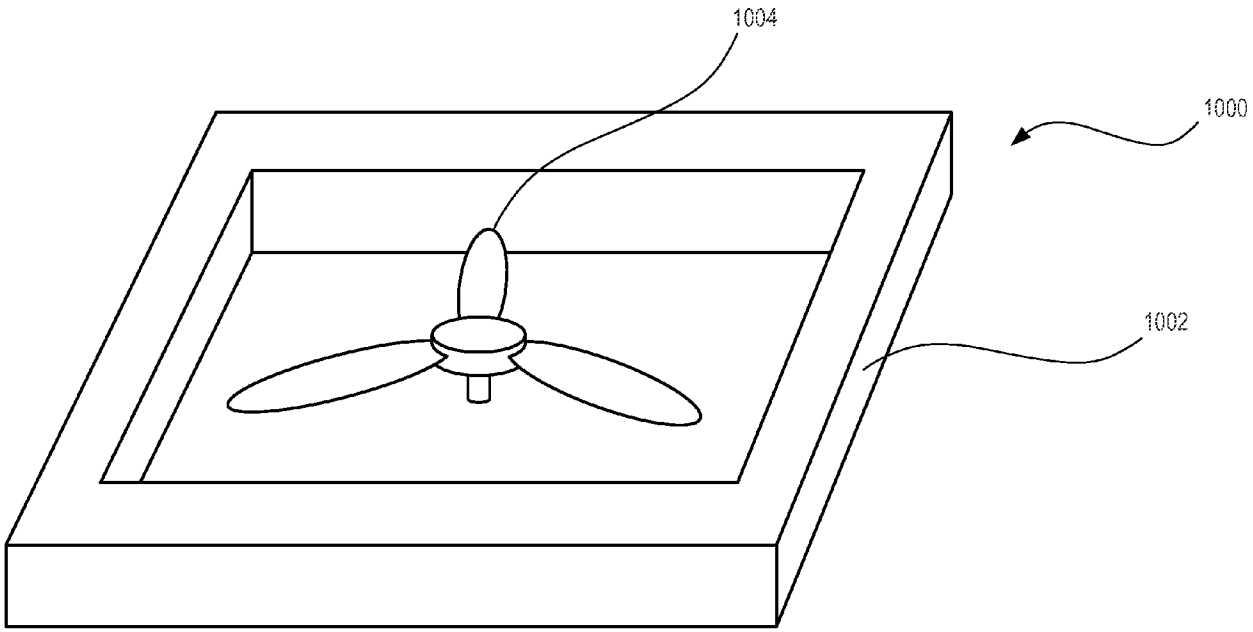
FIG. 10 is a perspective view of a reflective blade style electromagnetic pattern generator at a position G consistent with embodiments disclosed herein.
Figure 11:
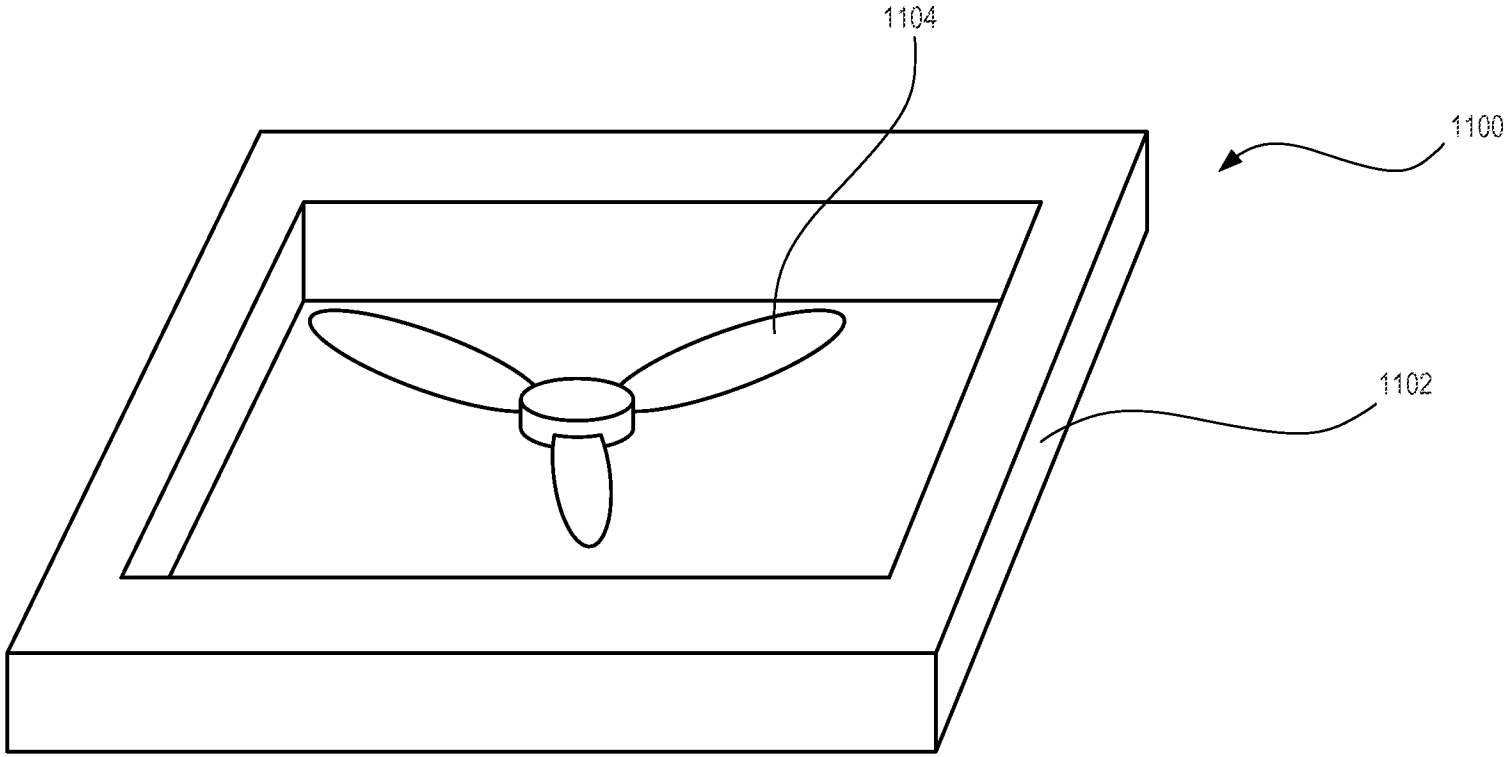
FIG. 11 is a perspective view of a reflective blade style electromagnetic pattern generator at a position H consistent with embodiments disclosed herein.
Figure 12:
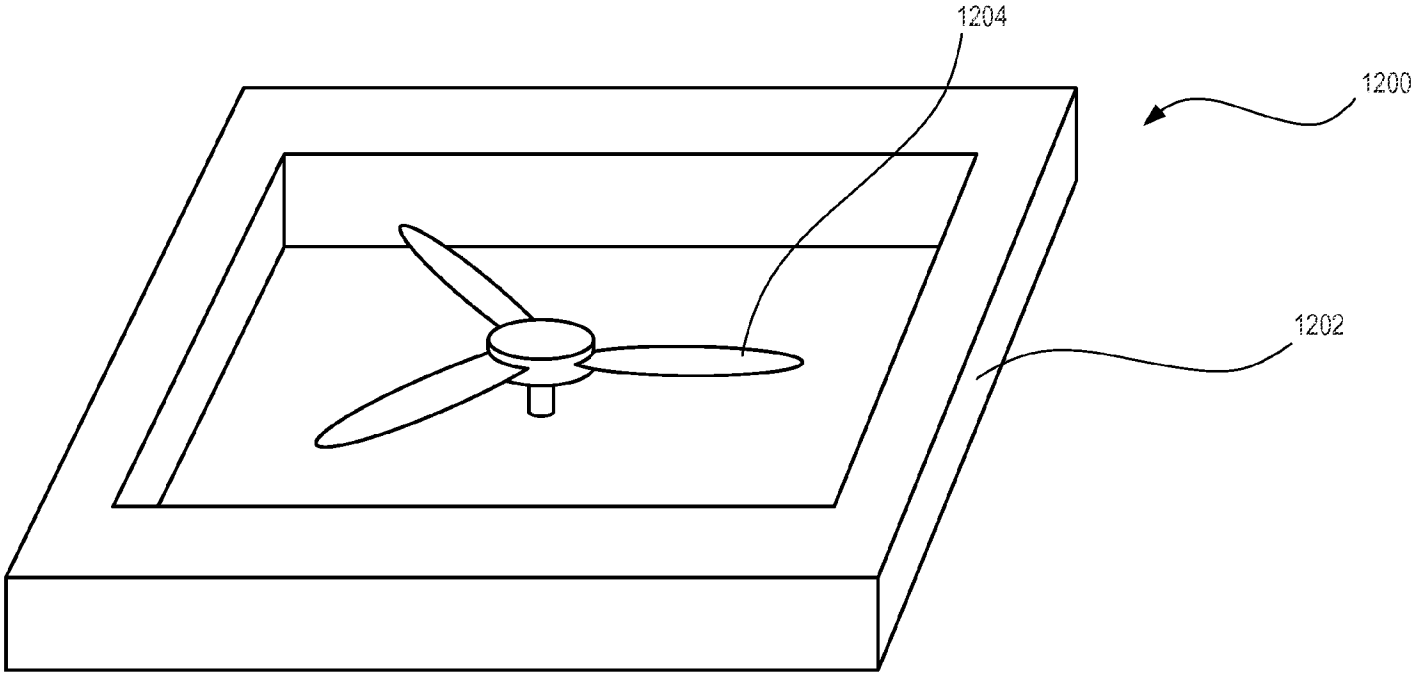
FIG. 12 is a perspective view of a reflective blade style electromagnetic pattern generator at a position I consistent with embodiments disclosed herein.
Figure 13:
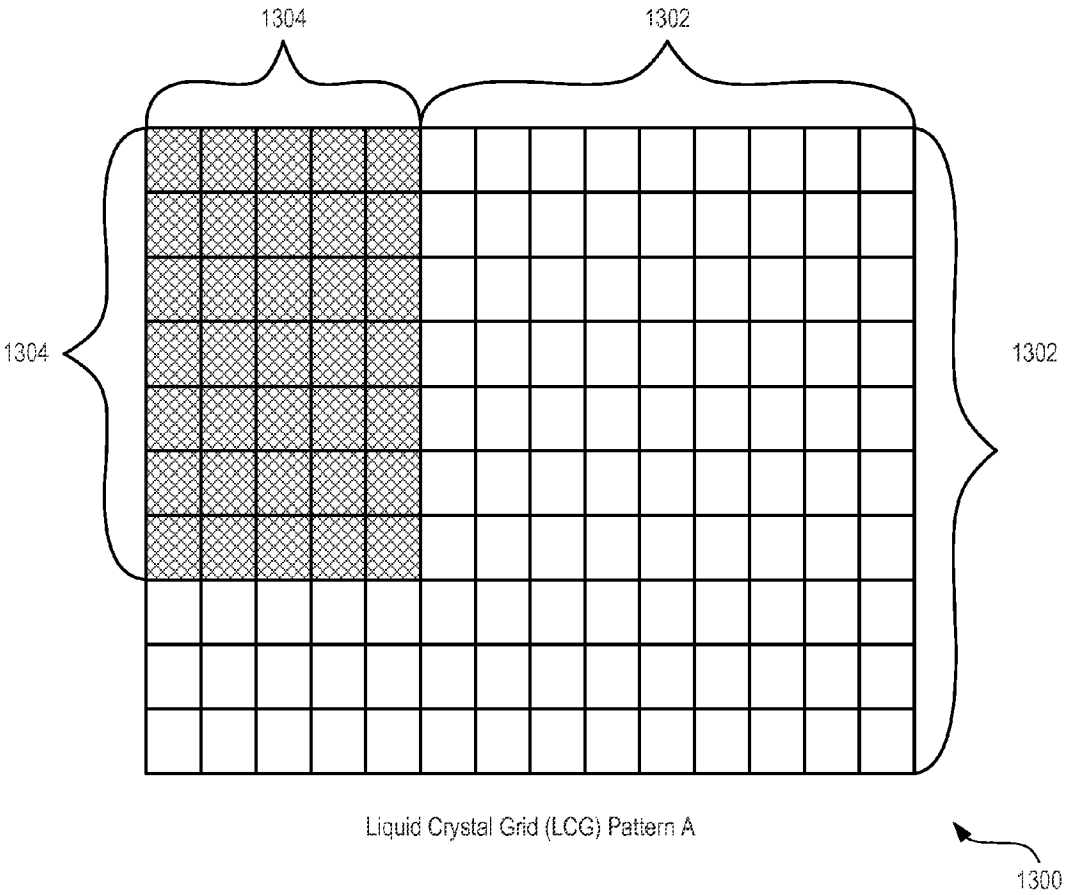
FIG. 13 is a diagram of a liquid crystal grid (LCG) pattern A consistent with embodiments disclosed herein.
Figure 14:
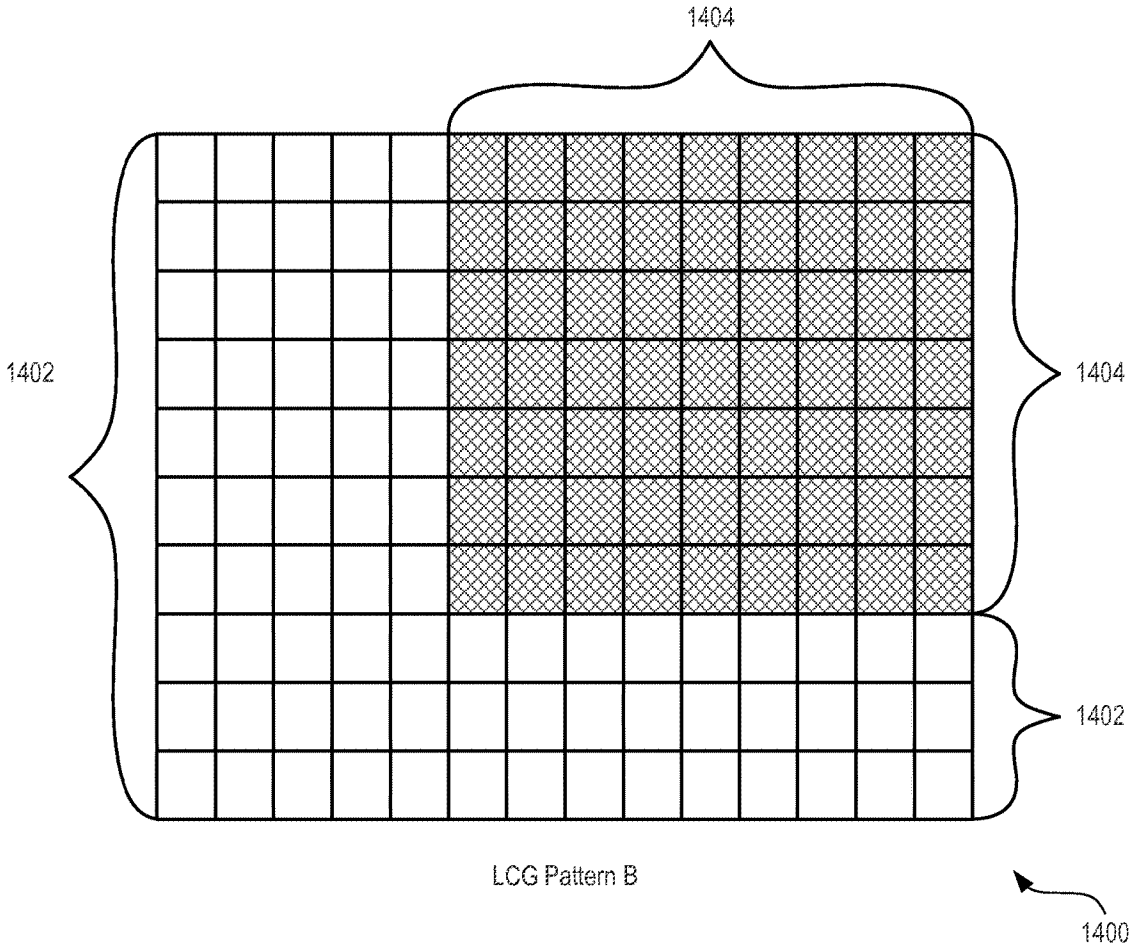
FIG. 14 is a diagram of an LCG pattern B consistent with embodiments disclosed herein.
Figure 15:
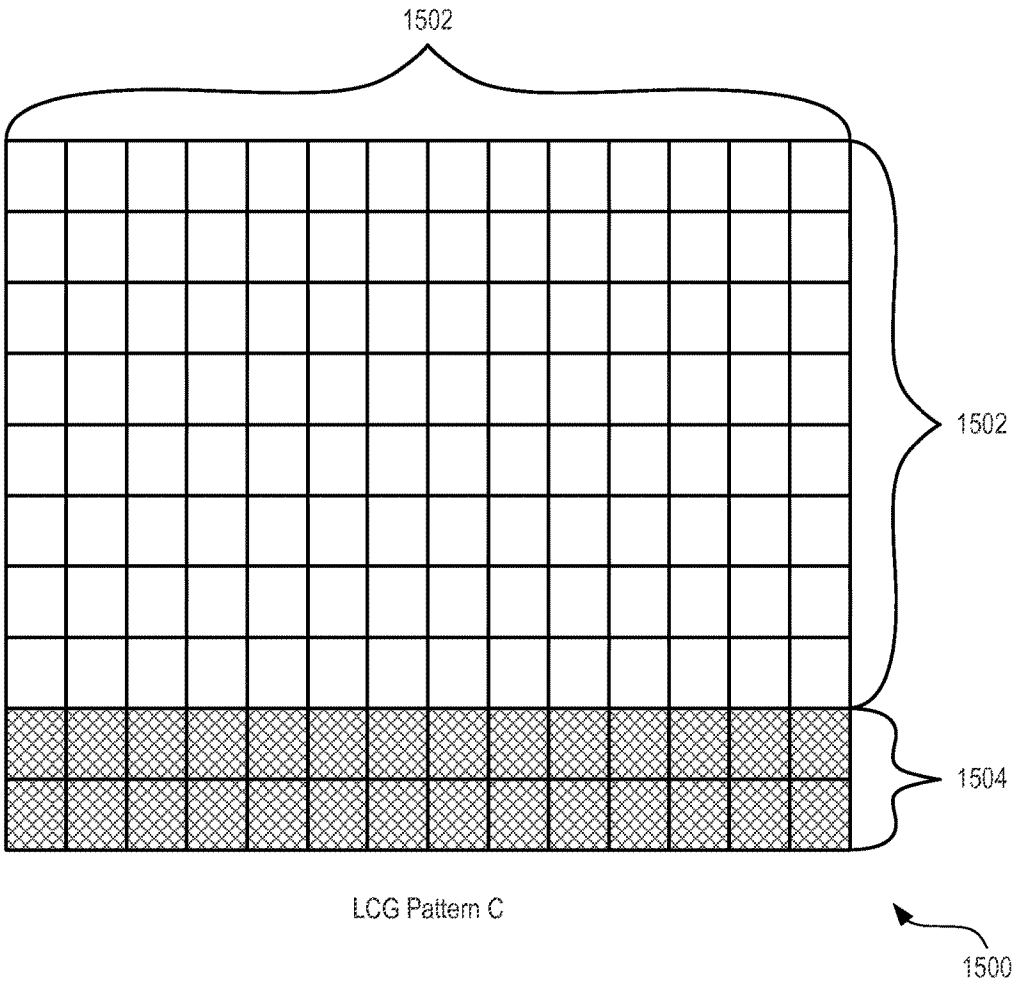
FIG. 15 is a diagram of an LCG pattern C consistent with embodiments disclosed herein.

FIGS. 9 to 15 provide examples of configurations of layers that when combined form composite patterns of amplitudes of radiofrequency energy. FIG. 9 shows a table identifying how combinations of patterns can be formed. FIGS. 10 to 12 show positions of a mode stirrer that correspond to the table in FIG. 9. FIGS. 13 to 15 show patterns of an LCG having configurable elements that can be opaque or transparent and used to control a transmission layer (such as a layer of metamaterial elements by tuning them toward or away from the antenna frequency).

FIG. 9 is a table 900 identifying patterns of a reflective blade style electromagnetic pattern generator consistent with embodiments disclosed herein. The Y-axis identifies three rotational positions of the reflective blade style electromagnetic pattern generator shown in FIGS. 10 to 12, which are positions G, H and I. Intermediate positions of the reflective blade style electromagnetic pattern generator between identified positions are identified as G, H; G, I; and H, I. The X-axis identifies patterns shown in FIGS. 13 to 15, which are patterns A, B and C. Combined patterns of the LCG (where the patterns are overlaid) are identified as A, B; A, C; and B, C. A composite pattern number is identified in each table entry. For example, a composite pattern of LCG pattern A and pattern generator position G is identified as composite pattern 1. With six positions times six LCG patterns, a resulting 36 composite patterns can be formed, showing a multiplicative effect of composite patterns.

FIGS. 10 to 12 show a series of rotational positions of a reflective blade style electromagnetic pattern generator in a backplane layer. FIG. 10 is a perspective view 1000 of a reflective blade style electromagnetic pattern generator 1004 at a first position G in a backplane layer 1002. FIG. 11 is a perspective view 1100 of a reflective blade style electromagnetic pattern generator 1104 at a position H in a backplane layer 1102. FIG. 12 is a perspective view 1200 of a reflective blade style electromagnetic pattern generator 1204 at a position I in a backplane layer 1202.

FIGS. 13 to 15 show diagrams of a series of liquid crystal grid (LCG) patterns of an LCG layer having an opaque set of elements and a transparent set of elements. FIG. 13 is a diagram of an LCG pattern A of an LCG layer 1300 having an opaque set of elements 1304 and a transparent set of elements 1302. FIG. 14 is a diagram of an LCG pattern B 1400 having an opaque set of elements 1404 and a transparent set of elements 1402. FIG. 15 is a diagram of an LCG pattern C of an LCG layer 1500 having an opaque set of elements 1504 and a transparent set of elements 1502.

Figure 16:
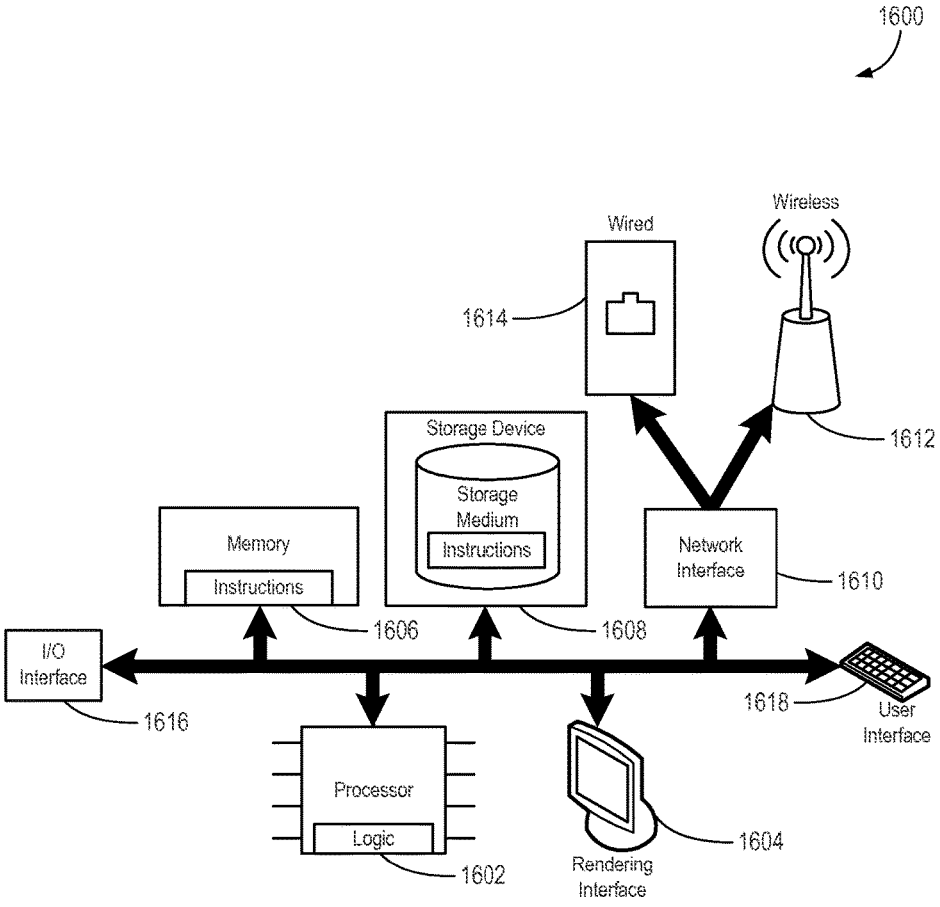
FIG. 16 is a schematic diagram of a computing system consistent with embodiments disclosed herein.

FIG. 16 is a schematic diagram of computing system 1600 consistent with embodiments disclosed herein. Computing system 1600 can be viewed as an information passing bus that connects various components. In the embodiment shown, computing system 1600 includes processor 1602 having logic for processing instructions. Instructions can be stored in and/or retrieved from memory 1606 and storage device 1608, which includes a computer-readable storage medium. Instructions and/or data can arrive from network interface 1610, which can include wired 1614 or wireless 1612 capabilities. Instructions and/or data can also come from I/O interface 1616, which can include such things as expansion cards, secondary buses (e.g., USB, etc.), devices, etc. A user can interact with computing system 1600 though user interface devices 1618 and rendering system 1604, which allows the computer to receive and provide feedback to the user.

Embodiments and implementations of the systems and methods described herein may include various operations, which may be embodied in machine-executable instructions to be executed by a computer system. A computer system may include one or more general-purpose or special-purpose computers (or other electronic devices). The computer system may include hardware components that include specific logic for performing the operations or may include a combination of hardware, software, and/or firmware.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines which communicate with other machines by physical transport of media. In particular, a suitable network may be formed from parts or entireties of two or more other networks, including networks using disparate hardware and network communication technologies.

One suitable network includes a server and one or more clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smart phone, personal digital assistant or other hand-held computing device, "smart" consumer electronics device or appliance, medical device, or combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables, telephone lines, radio waves, satellites, microwave relays, modulated AC power lines, physical media transfer, and/or other data transmission "wires" known to those of skill in the art. The network may encompass smaller networks and/or be connectable to other networks through a gateway or similar mechanism.

Various techniques, or certain aspects or portions thereof, may take the form of program code (i.e., instructions) embodied in tangible media, such as floppy diskettes, CD-ROMs, hard drives, magnetic or optical cards, solid-state memory devices, a non-transitory computer-readable storage medium, or any other machine-readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and non-volatile memory and/or storage elements), at least one input device, and at least one output device. The volatile and non-volatile memory and/or storage elements may be a RAM, an EPROM, a flash drive, an optical drive, a magnetic hard drive, or another medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s) may be implemented in assembly or machine language, if desired. In any case, the language may be a compiled or interpreted language, and combined with hardware implementations.

Each computer system includes one or more processors and/or memory; computer systems may also include various input devices and/or output devices. The processor may include a general-purpose device, such as an Intel®, AMD®, or other "off-the-shelf" microprocessor. The processor may include a special-purpose processing device, such as ASIC, SoC, SiP, FPGA, PAL, PLA, FPLA, PLD, or other customized or programmable device. The memory may include static RAM, dynamic RAM, flash memory, one or more flip-flops, ROM, CD-ROM, DVD, disk, tape, or magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

It should be understood that many of the functional units described in this specification may be implemented as one or more components, which is a term used to more particularly emphasize their implementation independence. For example, a component may be implemented as a hardware circuit comprising custom very large scale integration (VLSI) circuits or gate arrays, or off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together, but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components, and may be embodied in any suitable form and organized within any suitable type of data structure. The operational data may be collected as a single data set, or may be distributed over different locations including over different storage devices, and may exist, at least partially, merely as electronic signals on a system or network. The components may be passive or active, including agents operable to perform desired functions.

Several aspects of the embodiments described will be illustrated as software modules or components. As used herein, a software module or component may include any type of computer instruction or computer-executable code located within a memory device. A software module may, for instance, include one or more physical or logical blocks of computer instructions, which may be organized as a routine, program, object, component, data structure, etc., that perform one or more tasks or implement particular data types. It is appreciated that a software module may be implemented in hardware and/or firmware instead of or in addition to software. One or more of the functional modules described herein may be separated into sub-modules and/or combined into a single or smaller number of modules.

In certain embodiments, a particular software module may include disparate instructions stored in different locations of a memory device, different memory devices, or different computers, which together implement the described functionality of the module. Indeed, a module may include a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Reference throughout this specification to "an example" means that a particular feature, structure, or characteristic described in connection with the example is included in at least one embodiment of the present invention. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of materials, frequencies, sizes, lengths, widths, shapes, etc., to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive, and the invention is not to be limited to the details given herein, but may be modified within the scope and equivalents of the appended claims.

Those having skill in the art will appreciate that many changes may be made to the details of the above-described embodiments without departing from the underlying principles of the invention. The scope of the present invention should, therefore, be determined only by the following claims.

What is claimed is:

1. A method of forming patterns of radiation, comprising:

providing radiofrequency energy into a backplane structure;

forming a first pattern of electromagnetic amplitudes within the backplane structure by changing a position of a movable element to a first position that interacts with the radiofrequency energy;

coupling an energy distribution within the backplane structure to an emitting structure over at least one surface, the emitting structure comprising a set of free space radiators and having a first spatially dependent amplitude or phase transmission;

coupling the backplane structure to the set of free space radiators through the emitting structure by coupling the energy distribution within the backplane structure to the emitting structure over the at least one surface.

2. The method of claim 1, wherein the movable element is a movable conductor that changes electromagnetic characteristics of a portion of the backplane structure.

3. The method of claim 1, further comprising selecting the first pattern of electromagnetic amplitudes from a set of stochastic patterns of electromagnetic amplitudes based on a position of the moving element.

4. The method of claim 1, wherein coupling an energy distribution within the backplane structure to an emitting structure further comprises providing the radiofrequency energy from the backplane structure to a first subset of an array of sub-wavelength antenna elements configured to emit a first electromagnetic beam pattern in response to the radiofrequency energy from the backplane structure.

5. The method of claim 1, wherein coupling an energy distribution within the backplane structure to an emitting structure further comprises providing the radiofrequency energy from the backplane structure to a first subset of an array of sub-wavelength antenna elements configured to emit a first electromagnetic beam pattern in response to the radiofrequency energy from the backplane structure, the first electromagnetic beam pattern based at least in part on the first pattern of electromagnetic amplitudes and the first subset of the array of sub-wavelength antenna elements.

6. The method of claim 5, wherein each of the sub-wavelength antenna elements comprises at least one electromagnetically resonant element, and wherein a physical diameter of individual sub-wavelength antenna elements is less than an effective wavelength of an electromagnetic emission from the free space radiators.

7. The method of claim 6, wherein providing the radiofrequency energy from the backplane structure to the first subset of the array of sub-wavelength antenna elements further comprises forming a wavefront of the first electromagnetic beam pattern.

8. The method of claim 7, further comprising providing the wavefront of the first electromagnetic beam pattern to the free space radiators from the array of sub-wavelength antenna elements.

9. The method of claim 1, wherein the backplane structure further comprises a cavity.

10. The method of claim 9, wherein the backplane structure further comprises a two-dimensional cavity.

11. The method of claim 9, wherein the backplane structure further comprises a three-dimensional cavity.

12. A beam forming system, comprising:

an electromagnetic feed providing radiofrequency energy;

a first layer comprising:

a backplane region configured to receive the radiofrequency energy from the electromagnetic feed; and a movable electromagnetically responsive element configured to interact with the radiofrequency energy within the backplane region to form a first spatial distribution of amplitudes of radiofrequency energy, wherein the movable electromagnetically responsive element is configured to operate in a plurality of selectable states that result in a corresponding spatial distribution of amplitudes of radiofrequency energy from a set of spatial distributions of amplitudes of radiofrequency energy based at least in part on a selected state;

a second layer comprising:

an emitting structure comprising a set of free space radiators and having a first spatially dependent amplitude transmission, the emitting structure configured to couple the first spatial distribution of amplitudes of radiofrequency energy from the backplane region to the set free space radiators through the emitting structure by coupling the radiofrequency energy in the backplane structure to the emitting structure over at least one surface.

13. The system of claim 12, wherein the emitting structure further comprises:

an array of sub-wavelength antenna elements, each configured to emit an electromagnetic emission in response to received radiofrequency energy, wherein each of the sub-wavelength antenna elements comprises at least one electromagnetically resonant element, and wherein a physical diameter of individual sub-wavelength antenna elements is less than an effective wavelength of the electromagnetic emission.

14. The system of claim 12, wherein the selected state of the movable electromagnetically responsive element is a position of the movable electromagnetically responsive element.

15. The system of claim 14, further comprising an oscillating structure configured to alter the position of the movable electromagnetically responsive element.

16. The system of claim 15, wherein the oscillating structure further comprises a resonant oscillating structure wherein a timing of a pulse repetition frequency in relation to a resonant frequency of the resonant oscillating structure selects a spatial distribution of amplitudes of radiofrequency energy from the set of spatial distributions of amplitudes of radiofrequency energy.

17. The system of claim 16, wherein the pulse repetition frequency of the radiofrequency energy is at least four times larger than a frequency of the resonant oscillating structure.

18. The system of claim 14, wherein the first spatial distribution of amplitudes is formed by altering an electromagnetic behavior of the backplane region by moving a conductive portion of the movable electromagnetically responsive element within the backplane region.

19. The system of claim 18, wherein altering the electromagnetic behavior of the backplane region further comprises altering an impedance or capacitance of a structure in the backplane region causing a change in a distribution of electromagnetic amplitudes within the backplane region.

20. An electromagnetic system, comprising:

an input providing input radiofrequency energy;

a mode stirrer configured to interact with incident radiofrequency energy with the input radiofrequency energy to form a set of spatial distributions of intensities with a selectable state of the mode stirrer causing a spatial distribution of intensities to be selected from the set of spatial distributions of intensities, the mode stirrer configured to operate in a plurality of selectable states associated with the set of spatial distributions of intensities;

an emitter configured to receive a first spatial distribution of intensities and radiate a first beam pattern; and a backplane cavity that includes the mode stirrer and is configured to provide radiofrequency energy modified by the spatial distribution of intensities to the emitter.

21. The system of claim 20, further comprising a non-contact switch operated by the mode stirrer to interact with the input radiofrequency energy to form the first spatial distribution of intensities.

22. The system of claim 21, wherein the mode stirrer further comprises a plurality of ports that are electrically presented as opened or closed based at least in part on a position of the mode stirrer.

23. The system of claim 22, wherein the plurality of ports further comprise slot radiators that are opened based at least in part on the position of the mode stirrer.

24. The system of claim 22, wherein the plurality of ports further comprise slot radiators that are capacitively shorted based at least in part on the position of the mode stirrer.

25. The system of claim 24, wherein the slot radiators are capacitively shorted based at least in part on a rotational position of the mode stirrer.

26. The system of claim 24, wherein the slot radiators are capacitively shorted based at least in part on an oscillation position of the mode stirrer.

27. The system of claim 20, wherein the mode stirrer is a side wall oscillator.

28. The system of claim 27, wherein the side wall oscillator is connected to an oscillator configured to modify a cavity shape of the backplane cavity to provide the set of spatial distributions of intensities based at least in part on a position of the side wall oscillator.

29. The system of claim 20, further comprising a plurality of feeds of radiofrequency energy that are configured to contribute to the set of spatial distributions of intensities by interference based at least in part on which of the plurality of feeds are actively transmitting radiofrequency energy.

30. A method of receiving patterns of radiation, comprising:

receiving incident radiofrequency energy into a receiving structure having a spatially dependent amplitude transmission;

coupling the receiving structure to a surface of a backplane structure;

forming a first pattern of electromagnetic amplitudes within the backplane structure based on the incident radiofrequency energy; and detecting a resulting radiofrequency energy after the incident radiofrequency energy passes through the receiving structure and the backplane structure using the first pattern of electromagnetic amplitudes.

31. The method of claim 30, wherein receiving incident radiofrequency energy further comprises directing the incident radiofrequency energy to an array of sub-wavelength antenna elements, each configured to emit an electromagnetic emission in response to received radiofrequency energy, wherein each of the sub-wavelength antenna elements comprises at least one electromagnetically resonant element, and wherein a physical diameter of individual sub-wavelength antenna elements is less than an effective wavelength of the electromagnetic emission.

32. The method of claim 30, wherein receiving incident radiofrequency energy further comprises selectively altering resonance behavior of an array of sub-wavelength resonators coupled to a liquid crystal matrix based at least in part on a state of the liquid crystal matrix.

33. The method of claim 30, wherein detecting the resulting radiofrequency energy further comprises receiving a signal describing detected radiofrequency energy from an electromagnetic detector coupled to the backplane structure.

34. The method of claim 30, wherein forming the first pattern of electromagnetic amplitudes further comprises selecting the first pattern of electromagnetic amplitudes from a set of electromagnetic amplitudes.

35. The method of claim 34, wherein the selecting the first pattern of electromagnetic amplitudes further comprises selecting a position of a movable element from a set of positions.

36. The method of claim 35, wherein selecting the position of the movable element further comprises selecting a rotational position of a set of reflective blades.

37. The method of claim 35, wherein selecting the position of the movable element further comprises selecting the position of a mechanically oscillating structure.

* * * * *